United States Patent [19]

Kähkipuro

[11] 4,380,275

[45] Apr. 19, 1983

[54] APPARATUS FOR INTERFACING WEIGHING DATA WITH A LIFT CONTROL SYSTEM

[75] Inventor: Matti Kähkipuro, Hyvinkää, Finland

[73] Assignee: Elevator GmbH, Baar, Switzerland

[21] Appl. No.: 277,021

[22] Filed: Jun. 24, 1981

[51] Int. Cl.[3] ..... B66B 1/44

[52] U.S. Cl. ..... 187/29 R

[58] Field of Search ..... 187/29

[56] References Cited

U.S. PATENT DOCUMENTS

| | | | |
|---|---|---|---|
| 3,323,606 | 6/1967 | Bruns et al. | 187/29 |
| 3,543,113 | 11/1970 | Miller | 187/29 UX |
| 3,614,996 | 10/1971 | Saito et al. | 187/29 |

FOREIGN PATENT DOCUMENTS

| | | | |
|---|---|---|---|
| 53-111952 | 9/1978 | Japan | 187/29 |
| 1526369 | 9/1978 | United Kingdom | 187/29 |

*Primary Examiner*—J. V. Truhe

*Assistant Examiner*—W. E. Duncanson, Jr.

[57] ABSTRACT

Apparatus for interfacing weighing data with a lift control system that has been carried out with an operator amplifier circuit comprising a speed controller amplifier (NS) of which the plus terminal has been connected to ground and at the minus terminal enter the speed set-point value and the current speed value and further from the minus terminal has been connected to the output of the speed controller amplifier a stabilizing resistor (R1), and a stabilizing capacitor (C1). The apparatus comprises a start switch (K1) which short-circuits the stabilizing resistor (R1) and an auxiliary start switch (K1A) which connects the juncture of the stabilizing resistor (R1) and capacitor (C1) to the terminals of the weighing data resistors (R7) and (R8). The other end of the latter weighing datum resistor (R8) is connected to the output of the speed controller amplifier (NS) and to the other end of the foremost weighing datum resistor (R7) has been connected the external weighing datum.

1 Claim, 3 Drawing Figures

APPARATUS FOR INTERFACING WEIGHING DATA WITH A LIFT CONTROL SYSTEM

The present invention concerns apparatus serving to interface weighing data with a lift control system that has been carried out with an operator amplifier circuit comprising a speed controller amplifier of which the plus terminal is connected to ground and at the minus terminal arrive the speed set-point value and the current speed value, and furthermore from the minus terminal have been connected to the output of the speed controller amplifier, a stabilizing resistor and a stabilizing capacitor.

In apparatus of this kind known in prior art, the circuit contains as an essential component, a memory unit—without which the weighing datum cannot be interfaced with the control system with any success, because if there is no memory unit, removal of the weighing datum will give rise to a harmful jerk in the running of the lift. The governing of the weighing memory unit, and its existence in itself, introduces objectionable complexity into the circuitry.

The object of the apparatus of the invention is to eliminate the drawbacks mentioned and to provide a simple and reliably operating weighing data interfacing system. The apparatus of the invention is characterized in that a start switch short-circuits the stabilizing resistor, and an auxiliary start switch connects the juncture of the stabilizing resistor and capacitor to the terminals of the weighing datum resistors, and that the other end of the latter weighing datum resistor is connected to the output of the speed controller amplifier and to the other end of the foremost weighing datum resistor has been connected to the external weighing datum. The advantage is that a jolt-free starting of the lift is achieved without need to have a separate weighing memory unit with its attendant complexity. Moreover, in the apparatus of the invention the dynamics of the control system are full at all times. Hereby the active range, i.e. the output voltage, of the controller amplifier is not reduced, as it is in the old principle.

Figure 1:
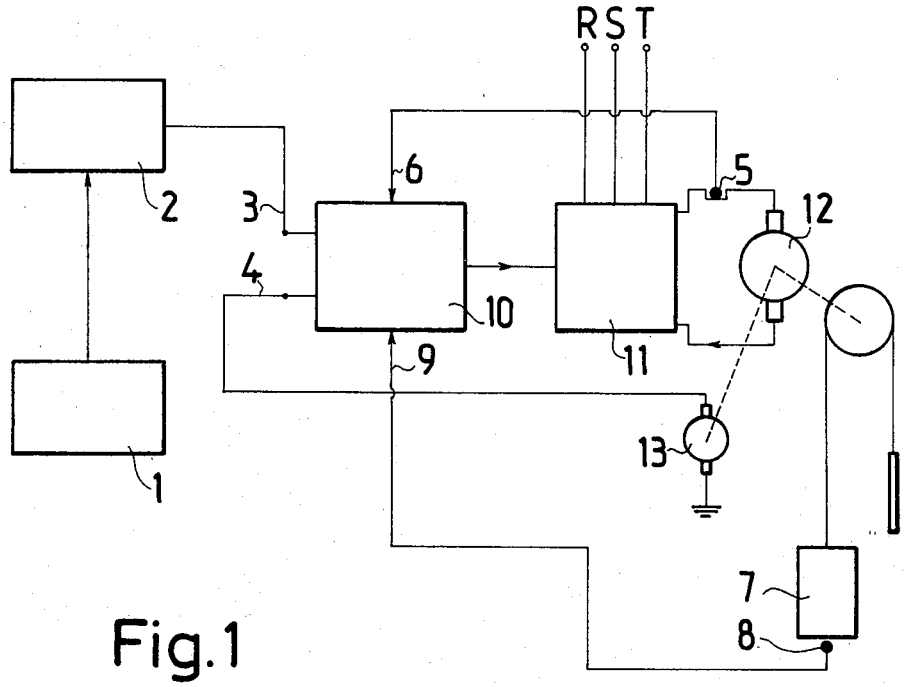

In the following the invention is described in greater detail with the aid of drawings, wherein:

FIG. 1 presents the circuit arrangement of the lift, schematically.

Figure 2:
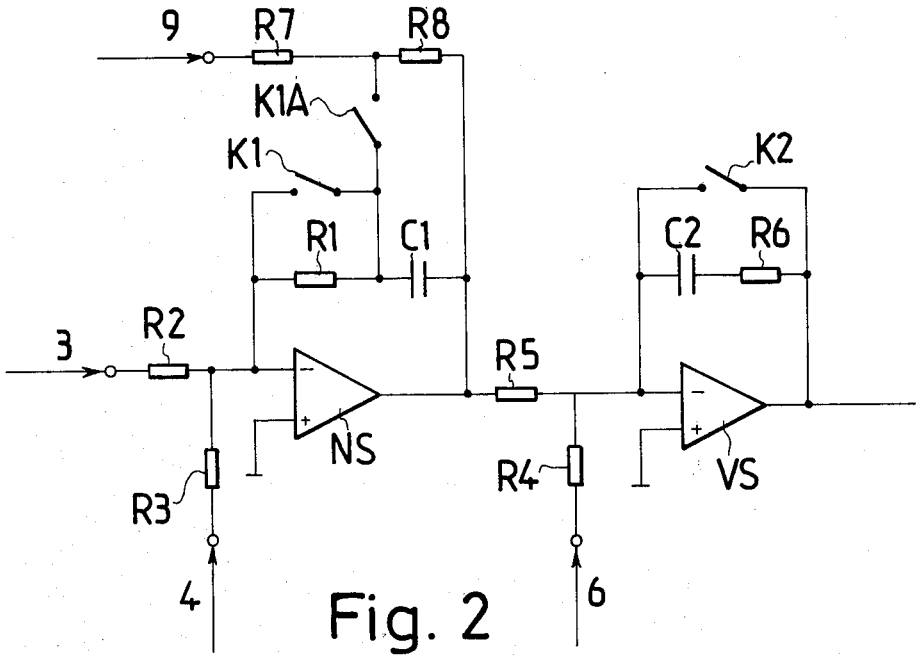

FIG. 2 shows the circuit of the invention, and

Figure 3:
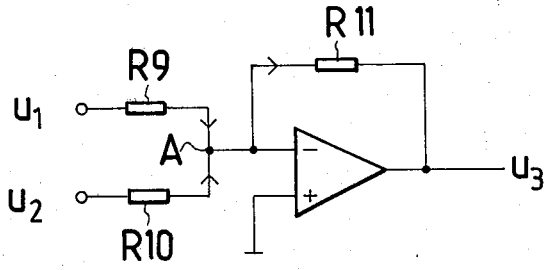

FIG. 3 displays the principle of the summing amplifier.

In FIG. 1, the logics of the lift (such as call buttons, etc.) have been indicated with the reference numeral 1, the speed directive forming with 2, the speed set-point value with 3, the current speed value with 4, the electrical current intensity measuring means with 5, and the current intensity value with 6, the lift cage with 7 including weighing pick-ups 8, the weighing datum with 9, and the weighing datum interfacing unit with 10. The power pack 11 has been connected to the lift motor 12. Also connected to the lift motor 12 is a tachometer generator 13, which supplies the current speed value 4 to the weighing datum interface 10.

In the circuit in FIG. 2, the speed controller amplifier NS is a proportional-integrating controller and it has in the feedback a stabilizing capacitor C1 and stabilizing resistor R1. The resistor R2 serves as input path for the current speed value. The speed controller amplifier NS computes the difference between the speed set-point value and current value. The stability of the system is determined by the aid of the circuit R1 and C1.

Another operator amplifier serves as current controller VS and into it is input the speed set-point value, which is the output voltage of the speed controller amplifier NS. The current speed value comes from a measuring means. The resistor R6 and capacitor C2 similarly determine the stability of the current control loop. As a rule, in controllers of the kind which have in their circuit a capacitor, there must always be made a starting value setting before the controller is activated, i.e., before the system governed by the controller is started up. Normally, the initial value setting is carried out in the current controller like has been done here, with the aid of a switch K2 so that the initial value at the switch K2 is kept at zero until the system is activated. In the apparatus of the invention the initial value of the speed controller (NS) is different from zero, and it is set with the aid of the switches K1 and K1A and, further, with the resistors R7 and R8. The initial value of the controller is then present as a state of charge in the capacitor C1, and at the same time it constitutes the preliminary electric current directive value since it goes through the resistor R5 as current set-point value to the current controller VS. As a result, there is a certain preliminary current in the circuit, corresponding to the load imposed on the lift. Hereby a jerk-free start is achieved. This is in fact the aim with the electric current setting, and it is thus understood that the preliminary current directive value conforms continuously to the weighing datum, which arrives through the resistors R7 and R8.

One may imagine the speed controller amplifier NS as an adding amplifier circuit when the switches K1 and K1A are closed, in which case the state of the amplifier is determined by the magnitude of resistors R7 and R8, as the theory of operator amplifiers sets forth. And when the switches K1 and K1A are open, the speed controller amplifier NS is converted into a controller having in the capacitor C1 a charge which is consistent with the weighing datum at that particular time; and thereafter, while the control is active, the charge of capacitor C1 remains automatically correct even later, as a consequence of the control system's normal operation. In this way the weighing datum can be taken care of without any memory unit, and with minor additions only. All that is added to a circuit with memory are the resistors R7 and R8, and this is a very minimal addition in view of the fact that the memory itself may now be omitted. The switches K1 and K2 are needed at all events. The circumstance that the current controller VS has only one switch K2, while there are two switches, K1 and K1A, in the speed controller NS, is explained by the fact that as a rule the time constant C1R1 is considerably greater in lifts than the time constant C2R6. The time constant C2R6 is mostly so small that the switch K2 has time to set zero change on the capacitor C2 fast enough. The time constant C1R1 however is so large that two switches are required for the charge on C1 to change fast enough.

The voltage arriving at the ends of resistors R2 and R3 gives rise to a current across the said resistors, and thereby a current corresponding to the voltage passes through the resistors, its porpotional constant being determined by the magnitude of the resistors. The minus input is, on operator amplifiers, a so-called virtual ground point where the voltage is zero at all times. This enables the inputs to be added up. The plus input is connected to ground. The normal model of an adding operator amplifier circuit is shown in FIG. 2. The virtual ground point has been indicated with A. The voltage U1 gives rise according to Ohm's law to a current across the resistor R9, having the intensity U1/R9; and similarly the voltage U2 produces the current U2/R10. Since A is a virtual ground point, the said currents do not interfere with each other and are instead mutually independent. Now the currents passing by the point A go, added together, all of them to the resistor R11, and consequently the output voltage U3 is proportional to the sum of the currents. As the switches K1 and K1A are closed in the actual circuit proper, the resistors R7 and R8 correspond to resistors R9 and R11, and owing to the switches the contribution of capacitor C1 and resistor R1 is eliminated.

It is clearly obvious to a person skilled in the art that the invention is not confined to the above example alone and that it may vary within the scope of different embodiments.

I claim:

1. Apparatus for interfacing weighing data with a lift control system that has been carried out with an operator amplifier circuit comprising a speed controller amplifier (NS) of which the plus terminal has been connected to ground and at the minus terminal enter the speed set-point value and the current speed value and further from the minus terminal has been connected to the output of the speed controller amplifier a stabilizing resistor (R1), a stabilizing capacitor (C1), a start switch (K1) which short-circuits the stabilizing resistor (R1), and an auxiliary start switch (K1A) which connects the juncture of the stabilizing resistor (R1) and capacitor (C1) to the terminals of the weighing data resistors (R7) and (R8), the other end of the latter weighing datum resistor (R8) being connected to the output of the speed controller amplifier (NS) and to the other end of the foremost weighing datum resistor (R7) being connected the external weighing datum.

* * * * *